US006951109B2

(12) United States Patent
Lemon et al.

(10) Patent No.: US 6,951,109 B2
(45) Date of Patent: Oct. 4, 2005

(54) APPARATUS AND METHODS FOR MINIMIZING AND/OR ELIMINATING DILUTION AIR LEAKAGE IN A COMBUSTION LINER ASSEMBLY

(75) Inventors: Donald Timothy Lemon, Greenville, SC (US); Ajay Kumar Gupta, Greer, SC (US)

(73) Assignee: General Electric Company, Schenectady, NY (US)

( * ) Notice: Subject to any disclaimer, the term of this patent is extended or adjusted under 35 U.S.C. 154(b) by 12 days.

(21) Appl. No.: 10/751,541

(22) Filed: Jan. 6, 2004

(65) Prior Publication Data

US 2005/0144954 A1 Jul. 7, 2005

(51) Int. Cl.[7] ..... F23R 3/54
(52) U.S. Cl. ..... 60/760; 60/39.37; 29/890.01
(58) Field of Search ..... 60/760, 39.37, 60/804, 752; 29/890.01

(56) References Cited

U.S. PATENT DOCUMENTS 5,487,275 A 1/1996 Borkowicz et al.
5,575,146 A * 11/1996 Borkowicz et al. ..... 60/776
6,374,594 B1 4/2002 Kraft et al.
6,427,446 B1 8/2002 Kraft et al.
6,651,437 B2 * 11/2003 Farmer et al. ..... 60/752
6,865,892 B2 * 3/2005 Garrido et al. ..... 60/798
2003/0233833 A1 12/2003 Martling et al.
2004/0112058 A1 6/2004 Garrido et al.

FOREIGN PATENT DOCUMENTS

EP 0564181 3/1993

* cited by examiner

*Primary Examiner*—Ehud Gartenberg
(74) *Attorney, Agent, or Firm*—Nixon & Vanderhye P.C.

(57) ABSTRACT

Variations in dilution air leakage paths in a gas turbine combustion liner assembly are minimized or eliminated to reduce emissions and variations in emissions from combustor to combustor. Leakage paths between the liner sleeve and venturi outer liner are minimized by using additional rivets at that joint. The leakage paths between the outer and inner sleeves of the venturi are eliminated by applying a peripheral weld to the end edges of the flanges of the outer and inner sleeves. The leakage paths between the venturi and outer liner are minimized while simultaneously maintaining accurate venturi throat area relative to the cap centerbody by match drilling holes through the liner sleeve and the overlapped flanges of the venturi and followed by riveting the parts together.

10 Claims, 3 Drawing Sheets

APPARATUS AND METHODS FOR MINIMIZING AND/OR ELIMINATING DILUTION AIR LEAKAGE IN A COMBUSTION LINER ASSEMBLY

BACKGROUND OF THE INVENTION

The present invention relates to apparatus and methods for minimizing or eliminating dilution air leakage paths in a gas turbine combustor and particularly relates to apparatus and methods for managing dilution air leakage to achieve lower emission levels.

As well known, significant products of combustion in gas turbine emissions are oxides of nitrogen, i.e., NO and $NO_2$ collectively called $NO_x$, carbon monoxide CO, and unburned hydrocarbons as well as other particulates. Various systems have been proposed and utilized for reducing emissions. For example, water or steam injection into the burning zone of the gas turbine combustor, catalytic clean-up of $NO_x$ and CO from the gas turbine exhaust and dry low $NO_x$ combustors have been used in the past. Compressor discharge dilution air introduced into the liner sleeve of the combustor and transition piece has also been utilized to reduce emissions.

BRIEF DESCRIPTION OF THE INVENTION

In accordance with an aspect of the present invention, dilution air management in a gas turbine combustion system has been demonstrated as a critical aspect in achieving lower emission levels. Particularly, there are known variations in the tolerances and assembly of the parts forming the dilution air management system in a combustor. Those variations significantly impact the variations in emission levels. Several areas in the combustor, particularly at joints between the parts of the combustor controlling the dilution air input, have been identified as contributing significantly to variations in leakage paths which greatly affect emissions.

In one aspect of the present invention, the combustor, particularly the liner sleeve and venturi have been modified in configuration and assembly processes to reduce variations in the dilution air leakage paths such that the magnitude of dilution air leakage from combustor to combustor is relatively constant and accounted for in the dilution air management system. Particularly, the combustor includes a liner sleeve surrounding a double walled venturi downstream of a cap centerbody. In one aspect of the present invention, the outer wall of the venturi and the liner sleeve are riveted to one another downstream of the venturi at closely spaced circumferential locations to reduce the leakage path and minimize variations in leakage path among identical combustors. In another aspect, the inner and outer venturi walls are overlapped to form axially extending annular flanges. The flanges are welded to one another about the annulus to close off one of the identified leakage paths. Consequently, dilution air leakage between the flanges, which were previously riveted to one another, is prevented. In a further aspect, the liner sleeve and the venturi wall flanges are match drilled using pre-drilled holes in the liner sleeve as guides to form the holes through the venturi flanges. Rivets are subsequently applied in the matched drilled holes and thus minimize the leakage of dilution air through the juncture between the venturi and the liner sleeve.

In a preferred embodiment according to the present invention, there is provided a combustion liner assembly for a gas turbine comprising a cap centerbody, a liner sleeve about said centerbody, a plurality of primary fuel nozzle cup assemblies within the liner sleeve and about the centerbody, a venturi downstream of the cap centerbody and nozzle cup assemblies and secured to the liner sleeve, the liner sleeve having an inlet for receiving dilution air into a plenum between the venturi and the liner sleeve for flow into a dilution zone downstream of the centerbody, the venturi including generally annular inner and outer sleeves spaced generally radially one from the other, the outer sleeve extending downstream from a throat of the venture, a plurality of rivets interconnecting the liner sleeve and the outer venturi sleeve at spaced circumferential locations about the liner sleeve for minimizing leakage flow of dilution air from the plenum and between the liner sleeve and outer venturi sleeve.

In a further preferred embodiment according to the present invention, there is provided a combustion liner assembly for a gas turbine comprising a cap centerbody, a liner sleeve about the centerbody, a plurality of primary fuel nozzle cup assemblies within the liner sleeve and about the centerbody, a venturi downstream of the cup centerbody and nozzle cap assemblies and secured to the liner sleeve, the liner sleeve having an inlet for receiving dilution air into a plenum between the venturi and the liner sleeve for flow into a dilution zone downstream of the centerbody, the venturi defining a throat area downstream of the centerbody and including generally annular inner and outer sleeves spaced generally radially from one another, the venturi outer sleeve having a plurality of holes in communication with the plenum for flowing dilution air between the inner and outer venturi sleeves, the inner and outer sleeves of the venturi having wall portions extending in an axial upstream and radial direction toward the liner sleeve and terminating in respective overlapped flanges extending in a generally axial direction and an annular weld about and sealing between the overlapped flanges to preclude dilution air leakage flow from the plenum.

In a further preferred embodiment according to the present invention, there is provided a method of securing an annular venturi to and along an inside surface of a liner sleeve of a gas turbine combustor to eliminate or minimize dilution air leakage between the liner sleeve and venturi, the venturi having an annular flange extending in a generally axial direction, comprising the steps of (a) forming a plurality of circumferentially spaced rivet holes about the liner sleeve, (b) locating the venturi within the liner sleeve with the flange aligned with the holes formed in the liner sleeve, (c) subsequent to step (b), forming holes through the venturi flange using the holes formed through the liner sleeve as guides and (d) riveting the liner sleeve and venturi flange to one another by passing the rivets through the aligned holes.

DETAILED DESCRIPTION OF THE INVENTION

Figure 1:
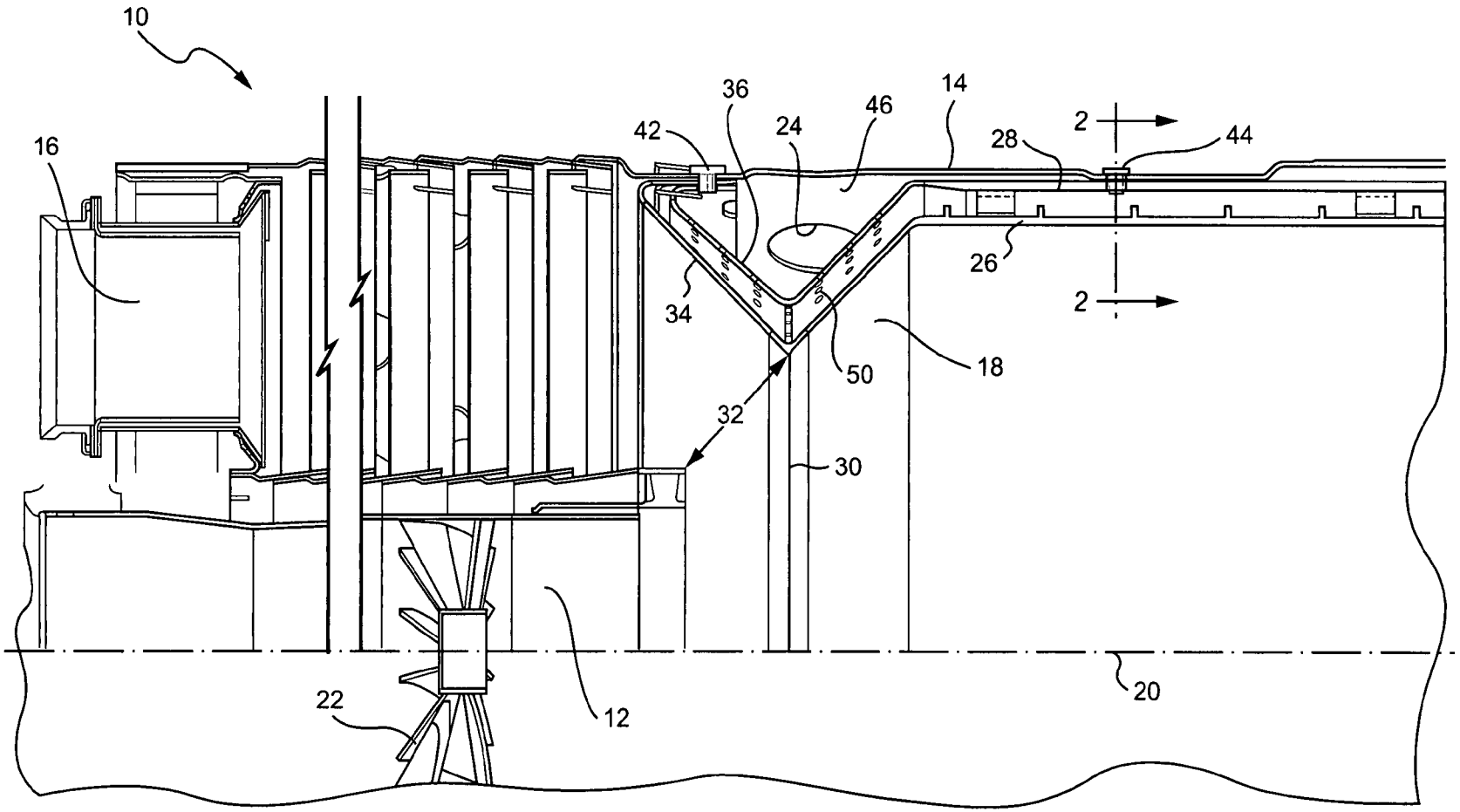
FIG. 1 is a fragmentary cross-sectional view of one-half of a combustion liner assembly about a combustor centerline.

Referring now to the drawings, particularly to FIG. 1, there is illustrated a combustion liner assembly, generally designated 10, including a cap centerbody 12, a liner sleeve 14, a primary fuel nozzle cup assembly 16 and a venturi 18. It will be appreciated that the combustion liner assembly 10 is cylindrical or annular in configuration about a centerline axis 20 and that a plurality of primary fuel nozzles 16 are spaced circumferentially one from the other about axis 20. A swirler 22 is shown as part of the cap centerbody 12. The liner sleeve 14 has an inlet including a plurality of circumferentially spaced apertures 24 which receive compressor discharge air from a plenum, not shown, between the combustion liner assembly and the combustion flowsleeve/casing, also not shown. The venturi 18 comprises a prefabricated double walled annular structure disposed within the liner sleeve 14 and includes an inner liner 26 and an outer liner 28. The venturi 18 has a radial inward apex 30 which defines a throat area 32 with the center cap body 12. The inner and outer liners 26 and 28 of venturi 18 include inner and outer wall portions 34 and 36, respectively, which extend axially upstream and radially outwardly toward cup assembly 16. The wall portions 34 and 36 terminate in a pair of flanges 38 and 40, respectively, which are turned to extend in a generally axially downstream direction. The flanges are secured to the liner sleeve 14 by rivets 42 in a manner described below. The outer liner 28 of venturi 18 is also secured to the liner sleeve 14 downstream of the venturi by a plurality of circumferentially spaced rivets 44. As best illustrated in FIG. 1, the liner sleeve 14 is recessed radially inwardly to overlay the outer liner 28 of venturi 18 forming essentially an indented band for securing the liner sleeve 14 and outer venturi sleeve 28 to one another.

Figure 2:
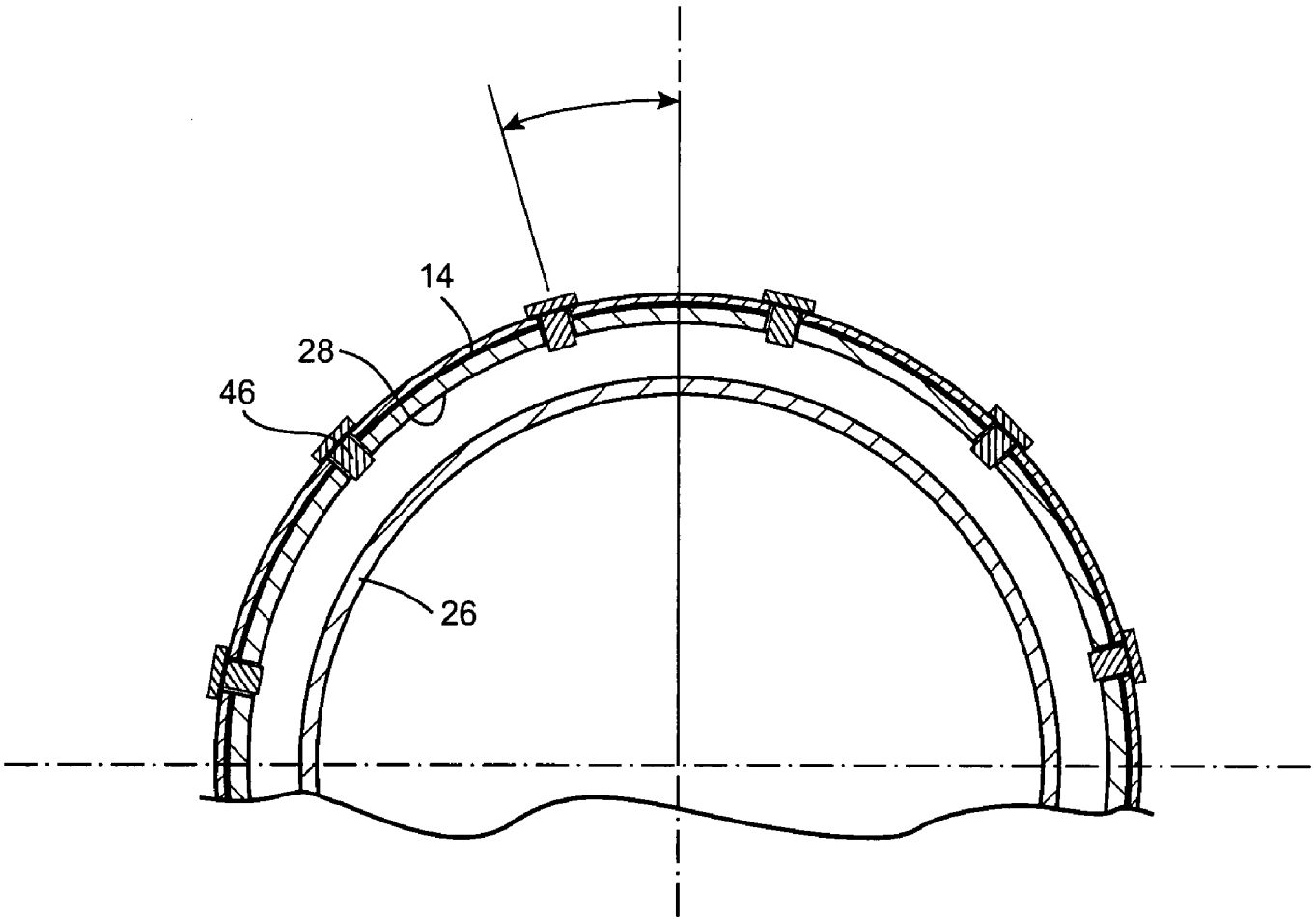
FIG. 2 is a cross-sectional view thereof taken generally about on line 2—2 in FIG. 1.
Figure 3:
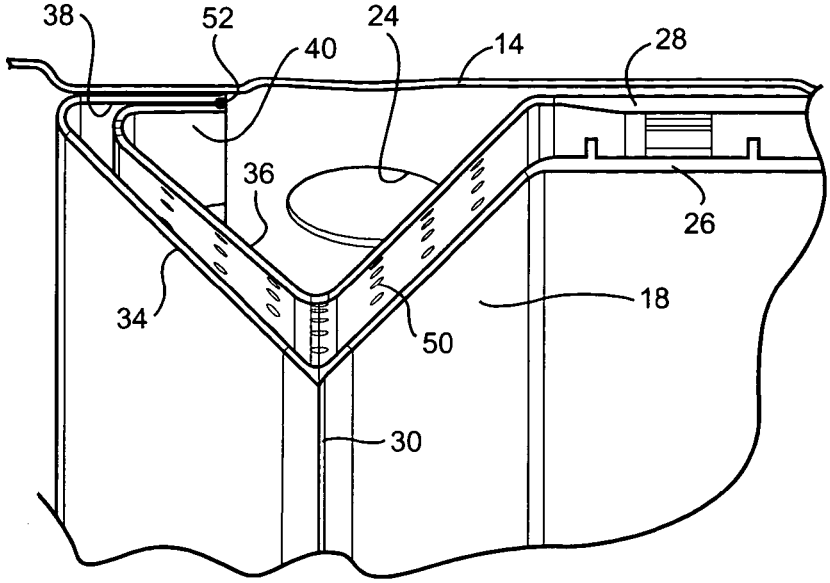
FIG. 3 is an enlarged fragmentary cross-sectional view illustrating the double wall and flange construction of the venturi.

It has been discovered that variations in the leakage paths of the dilution air supplied to the combustor have a significant effect on emissions and that these variations are a result of parts tolerances and assembly of the parts. For example, a primary leakage path of concern is between the liner sleeve 14 and the outer sleeve 28 of venturi 18 in the area of the rivets 44. It will be seen that the compressor discharge air supplied to the annular plenum 46 from externally of the combustion liner via apertures 24 may leak past the riveted connection. Previously, six rivets were utilized to secure the liner sleeve 14 and outer sleeve 28 to one another. Variations in leakage flow past the riveted joint, however, have been discovered with respect to various identical combustors and consequently emissions will vary. Those emissions resulting from leakage path flows heretofore have not been identified or controlled. In order to control the leakage flow past the riveted joint, additional rivets at closer circumferentially spaced locations about the joint between the liner sleeve and outer liner 28 are provided. These additional rivets control the gap and hence the leakage flow between the liner sleeve and outer liner to minimize or eliminate variations in leakage flow past the joint. Thus, as illustrated in FIG. 2, at least ten and preferably twelve or more rivets 46 are circumferentially spaced one from the other securing the liner sleeve 14 and the outer sleeve 28 of venturi 18 to one another. It will be appreciated that the liner sleeve and outer liner cannot be welded to one another since the venturi is sometimes removed from the liner sleeve during maintenance. Thus, some non-permanent type of joint between those parts is necessary.

As noted previously, there is an additional leakage path for the dilution air flowing from plenum 46 into the space between the inner and outer venturi sleeves 26 and 28, respectively, via apertures 50 in the outer venturi sleeve 28. This additional leakage path passes between the flanges 38 and 40 of the inner and outer liners 34 and 36 respectively of venturi 18. While these flanges 38 and 40 in the past engaged one another and were riveted to the liner sleeve 14, a variable gap between the flanges and from combustion liner to identical combustion liner appeared resulting in variable emissions from ostensibly identical combustors. To reduce the emissions and to preclude variations in emissions between identical combustors, the flanges 38 and 40, in accordance with the preferred aspect of the present invention, are sealed to one another. The seal preferably is in the form of a weld 52 (FIGS. 3–7) applied between the flanges 38 and 40 along their end edges and peripherally about the joint. It will be appreciated that by applying a weld peripherally about the combustion liner and between the flanges 38 and 40, the prior leakage gap is entirely eliminated.

A further leakage gap appears between the liner sleeve 14 and the overlapped flanges 38 and 40 of venturi 18. These gaps have been demonstrated to vary between identically constructed combustors and hence result in leakage flows causing variable emissions. Also, it is important that the venturi throat area 32 must be maintained within predetermined limits, notwithstanding the removability of the venturi from the liner sleeve for maintenance and service. It is also important that the throat area be maintained upon original manufacture of the venturi and liner sleeve and throughout the various service procedures performed on the combustor during its life.

Figure 4:
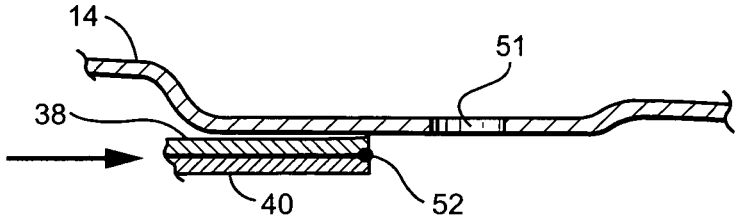
FIGS. 4–7 are fragmentary cross-sectional views illustrating the riveted assembly of the venturi and liner sleeve and the formation of the matched holes to receive the rivets.
Figure 5:
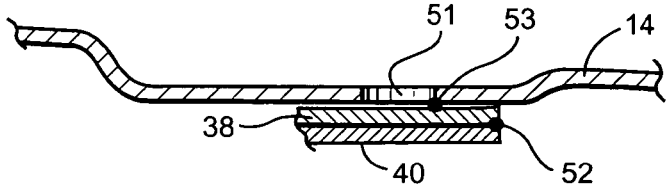
Figure 6:
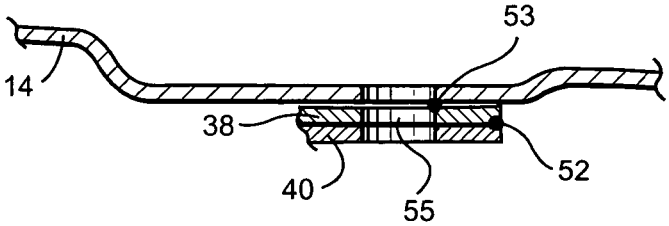
Figure 7:
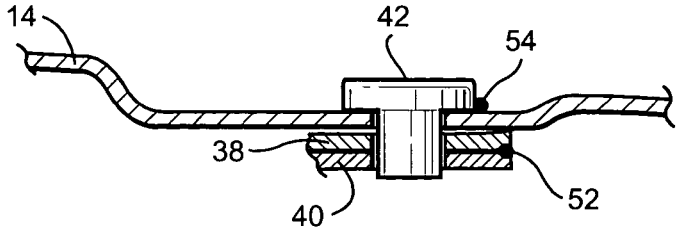

To reduce the leakage gap between the liner sleeve 14 and flanges 38 and 40 and to accurately maintain the throat area 32, the holes for the rivets 42 are match-formed, e.g., match-drilled. Previously, the rivet holes were formed separately at the part level. That is the rivet holes were drilled in both the venturi flanges 38 and 40 and the liner sleeve 14 prior to their assembly. In accordance with an aspect of the present invention, however, the rivet holes are match drilled. Particularly, rivet holes 51 are formed, preferably drilled, through the liner sleeve 14 at the part level. The venturi 18, without rivet holes being formed in the welded flanges, is then inserted into the liner sleeve 14 as illustrated in FIG. 4. The venturi is precisely located within the liner sleeve using measurements to ensure that the throat distance 32 to the cap centerbody is accurate. Once the venturi has been accurately positioned in the liner sleeve, the venturi and liner sleeve are tack welded preferably at three locations 120° apart to ensure that the desired distance in the throat area is maintained during final assembly. A tack weld is schematically illustrated at 53 in FIG. 5. With the venturi and liner sleeve tack welded to one another, the rivet holes 55 through the overlapped flanges 38 and 40 of the venturi 18 are formed, preferably drilled, using the previously formed holes 51 through the liner sleeve as guides, as illustrated in FIG. 6. This ensures proper location of the rivet holes relative to one another, reduces the leakage path once the rivets are applied and accurately maintains the throat area. As illustrated in FIG. 7, the rivets 42 are then applied through the match drilled holes and their heads are subsequently welded at 54 to the liner sleeve.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustion liner assembly for a gas turbine comprising:

a cap centerbody;

a liner sleeve about said centerbody;

a plurality of primary fuel nozzle cup assemblies within the liner sleeve and about the centerbody;

a venturi downstream of the cap centerbody and nozzle cup assemblies and secured to said liner sleeve;

said liner sleeve having an inlet for receiving dilution air into a plenum between the venturi and the liner sleeve for flow into a dilution zone downstream of the centerbody;

said venturi defining a throat area downstream of the centerbody and including generally annular inner and outer sleeves spaced generally radially from one another;

said venturi outer sleeve having a plurality of holes in communication with said plenum for flowing dilution air between the inner and outer venturi sleeves;

said inner and outer sleeves of said venturi having wall portions extending in an axial upstream and radial direction toward said liner sleeve and terminating in respective overlapped flanges extending in a generally axial direction; and an annular weld about and sealing between the overlapped flanges to preclude dilution air leakage flow from said plenum.

2. A combustion liner assembly according to claim 1 wherein said flanges extend in an axial downstream direction away from said centerbody and said nozzle cup assemblies.

3. A combustion liner assembly according to claim 1 wherein said outer venturi sleeve extends downstream from a venturi throat forming part of said venturi;

said outer venturi sleeve having a plurality of holes in communication with said plenum for flowing dilution air between the inner and outer venturi sleeves.

4. A combustion liner assembly according to claim 1 wherein said outer venturi sleeve extends downstream from a venturi throat forming part of said venturi and a plurality of rivets interconnecting said liner sleeve and said outer venturi sleeve at spaced circumferential locations about said liner sleeve for minimizing leakage flow of dilution air from the plenum and between the liner sleeve and outer venturi sleeve.

5. A combustion liner assembly according to claim 4 wherein said rivets are at least ten in number about the liner sleeve and equally spaced from one another about the liner sleeve.

6. A combustion liner assembly according to claim 4 wherein said rivets are at least twelve in number about the liner sleeve and equally spaced from one another about the liner sleeve.

7. A method of securing an annular venturi to and along an inside surface of a liner sleeve of a gas turbine combustor to eliminate or minimize dilution air leakage between the liner sleeve and venturi, the venturi having annular flanges extending in a generally axial direction, comprising the steps of:

(a) forming a plurality of circumferentially spaced rivet holes about the liner sleeve;

(b) locating the venturi within the liner sleeve with the flange aligned with the holes formed in the liner sleeve;

(c) subsequent to step (b), forming holes through the venturi flanges using the holes formed through the liner sleeve as guides; and (d) riveting the liner sleeve and venturi flanges to one another by passing the rivets through the aligned holes.

8. A method according to claim 7, including performing steps (a)–(d) in sequence and after step (b) and prior to step (c), tack-welding the venturi outer wall flange to the liner sleeve.

9. A method according to claim 8, including welding heads of the rivets to the liner sleeve.

10. A method according to claim 8 wherein the venturi has inner and outer sleeves terminating in overlapped flanges, and step (b) includes locating the venturi within the liner sleeve with the flanges aligned with the holes formed in the liner sleeve, step (c) includes forming holes through both flanges using the holes formed in the liner sleeve as guides and step (d) includes riveting the liner sleeve and flanges to one another by passing rivets through the aligned holes.

* * * * *